United States Patent [19]

Hino et al.

[11] 3,972,385

[45] Aug. 3, 1976

[54] HORN SPEAKER

[75] Inventors: Masanori Hino, Hirakata; Taro Eguchi, Osaka; Chitoshi Shiraga, Shimane, all of Japan

[73] Assignee: Onkyo Kabushiki Kaisha, Japan

[22] Filed: Jan. 14, 1974

[21] Appl. No.: 432,879

[30] Foreign Application Priority Data

| | | |
|---|---|---|
| Jan. 17, 1973 | Japan | 48-8056 |
| Jan. 17, 1973 | Japan | 48-8057 |
| Mar. 10, 1973 | Japan | 48-28438 |
| Mar. 19, 1973 | Japan | 48-31574 |

[52] U.S. Cl. ..... 181/192; 181/159; 181/195

[51] Int. Cl.[2] ..... G10K 11/00

[58] Field of Search ..... 181/192, 183, 195, 185, 181/152, 159

[56] References Cited

UNITED STATES PATENTS

| | | | |
|---|---|---|---|
| 1,185,988 | 6/1916 | English | 181/192 |
| 1,314,980 | 9/1919 | Pogonowski | 181/192 |
| 2,690,231 | 9/1954 | Levy et al. | 181/192 |

FOREIGN PATENTS OR APPLICATIONS

| | | | |
|---|---|---|---|
| 96,268 | 3/1924 | Austria | 181/192 |
| 473,046 | 9/1914 | France | 181/192 |
| 725,727 | 2/1932 | France | 181/192 |
| 409,293 | 2/1925 | Germany | 181/192 |
| 513,803 | 12/1930 | Germany | 181/192 |
| 955,249 | 1/1957 | Germany | 181/192 |
| 495,594 | 11/1938 | United Kingdom | 181/192 |
| 629,151 | 9/1949 | United Kingdom | 181/192 |

*Primary Examiner*—Stephen J. Tomsky
*Attorney, Agent, or Firm*—Edwin E. Greigg

[57] ABSTRACT

A horn speaker comprising a diaphragm positioned close to a throat and side walls forming sound passages for radiating the vibrations of the diaphragm effectively as sound waves from the mouth of the speaker.

4 Claims, 35 Drawing Figures

Fig. 17
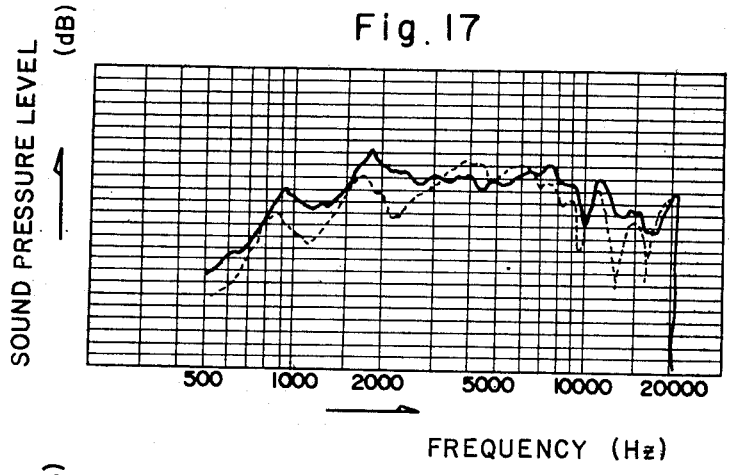
Fig. 17a
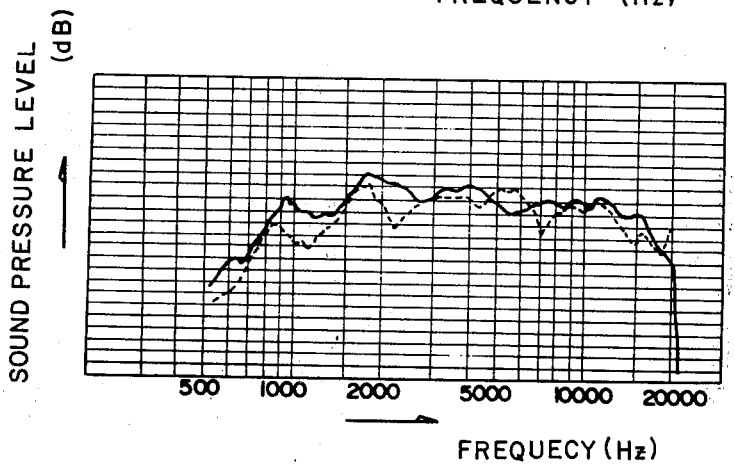
Fig. 17b
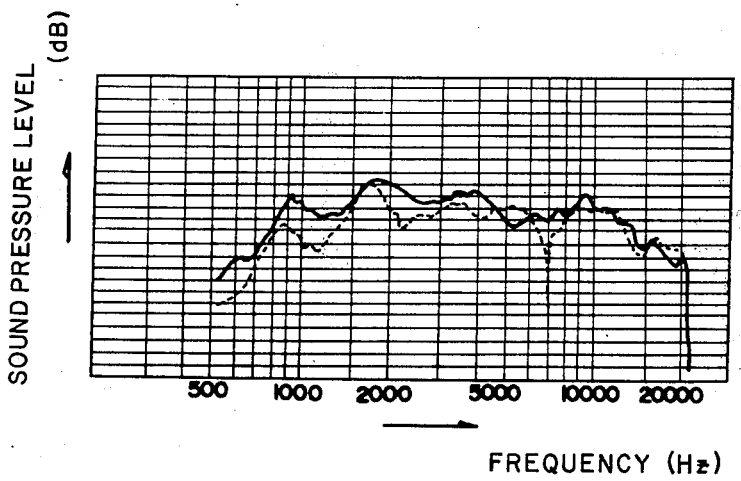
Fig. 17c

HORN SPEAKER

BACKGROUND OF THE INVENTION

The auditory response of the listener to the sounds reproduced in the room is greatly influenced by the diffusion of sound waves emerging from the speaker. At high acoustic frequencies, therefore, there is a need to use a speaker having wide directional characteristics.

Conventionally, horn-type speakers have chiefly been used as high- and mid-frequency speakers. However, horn speakers have the drawback of being low in directivity inasmuch as the sound wave is radiated from the horn mouth as a plane wave. Furthermore, a low-frequency reproduction with a horn speaker needs a greater horn length, entailing the drawback that the speaker becomes larger in its entirety.

To eliminate these drawbacks, various means have heretofore been employed. For example, a multi-cellular horn is known which comprises a multiplicity of horns of the same type so arranged as to form a part of spherical surface with the mouth of the horn. Also known is a sectoral horn having flaring side walls and upper and lower walls vertically caved in toward the principal axis of the horn to abruptly constrict the sound passage to elevate the sound pressure and to increase the medium density at the constricted portion, thereby increasing the phase velocity of sound wave, such that the sound waves will be radiated and spread out from the horn mouth in the form of a sector. Attempts have also been made to use materials to disperse sound waves or acoustical lenses.

Although the above-mentioned multi-cellular horn achieves a remarkable improvement in directional characteristics, it is disadvantageous in being complex in construction, expensive and large-sized. Further with the sectoral horn which is relatively inexpensive and has improved directional characteristics, it is difficult to effect reproduction at low frequencies without adverse effect. In fact, an attempt to overcome this difficulty has entailed the drawback that the horn becomes large. Furthermore, acoustical lenses and the like are not only expensive but also large and necessitate an increased space.

Thus none of the conventional horn speakers are satisfactory to fulfil all the requirements in respect of directional characteristics, low impedance characteristics, compactness and cost.

SUMMARY OF THE INVENTION

The present invention provides an inexpensive horn speaker free from the conventional drawbacks described and comprising the combination of a horn having different axial lengths, the horn speaker thereby being rendered highly directional over a wide range including high frequencies and relatively short in the overall length of the combined horns and having improved characteristics also at low frequencies.

The horn speaker of this invention comprises a diaphragm and side walls forming a sound passage for radiating sound waves emitted from the diaphragm, the sound passage having a substantially straight principal horn axis and a generally planar mouth surface positioned substantially in parallel to the inlet face of the horn, the area of the sound passage in section taken along a plane perpendicular to the principal horn axis increasing continuously at a substantially constant rate of area expansion from a throat to the plane of the mouth in the direction of the principal horn axis, the horn speaker being characterized in that at least one side wall has an inner surface curved along the principal horn axis to give the relationship represented by the equation:

$$l = -f + \sqrt{(lo + f)^2 + y^2}$$

wherein $l$ is the length of a passage for propagating sound waves from the diaphragm to a point at a distance of $y$ from the intersection of the principal horn axis with the mouth plane, the point being positioned on at least one first straight directional line contained in the mouth plane and passing through the intersection, $lo$ is the length of the principal horn axis and $f$ is a virtual focal distance.

With the relationship of the above equation thus given, the length $l$ of the passage for propagating a sound wave from the diaphragm to a point at a distance of $y$ from the intersection of the principal horn axis with the mouth plane is greater than the length $lo$ of the principal axis, so that the apparent velocity of sound wave as propagated along the length $l$ is lower than the velocity of sound wave propagated along the passage length $lo$. Consequently, the sound waves radiated from the mouth plane are refracted in a direction where the velocity is lower and are radiated and spread out in the form of an envelope centered about the virtual focal point, hence a wide range of directivity.

Further since the sound waves travel through passages of different lengths to emerge from the mouth plane, the impedance characteristics of the component horns are displaced from each other with respect to the frequency axis, whereby the valleys and peaks in the characteristics of the horns offset each other to give overall mouth characteristics and to thereby assure low-frequency reproduction without objections. It is therefore possible to provide a horn speaker which is lower, relative to its compactness, in threshould frequency for reproduction at low frequencies.

An object of this invention is to provide an inexpensive horn speaker which is relatively short in the overall length of horn and which nevertheless has wide directional characteristics and improved properties at low frequencies as well.

Another object of this invention is to provide a horn speaker which is simplified to the greatest possible extent in its interior construction so as to make the speaker easy and inexpensive to manufacture.

Still another object of this invention is to provide a horn speaker which is adapted to prevent, within the directional angle of sound wave, marked attenuation of sound pressure at a specific frequency so as to impart flat frequency characteristics to the speaker.

Other objects and advantages of this invention will become apparent from the following description.

BRIEF DESCRIPTION OF THE DRAWINGS

FIGS. 17(*a*), 17(*b*), 17(*c*) and 18 are diagrams showing the frequency characteristics of the horn speaker of FIG. 13 and a diagram showing the relationship between the difference in passage length and sound pressure level relating to the same speaker;

DESCRIPTION OF THE PREFERRED EMBODIMENTS

Figure 1:
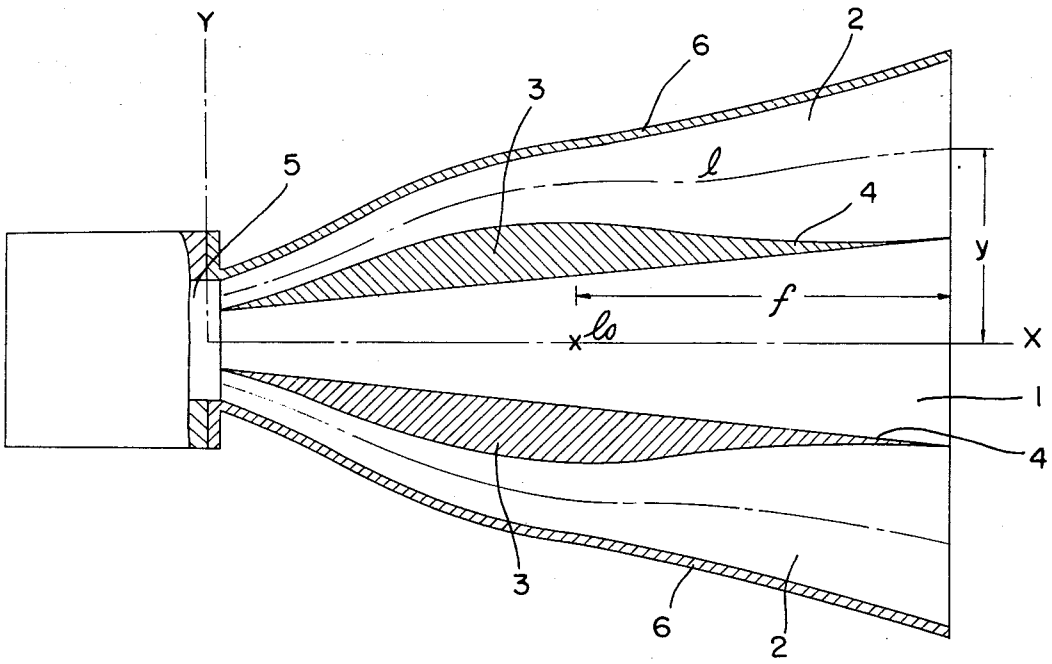
FIG. 1 is a view illustrating the principle of the horn speaker according to this invention.

With reference to FIG. 1, the principle of the horn speaker according to the present invention will be described. Within the sound passage of a horn, two partition walls 4 and 4 extending from a throat 5 to a mouth are arranged symmetrically with respect to the straight principal axis of the horn to divide the horn into three sound passages 1, 2 and 2. The two sound passages 2 and 2 have the same length. One diaphragm is positioned close to the throat 5 and the surface of the mouth is generally planar. The plane of the mouth is substantially in parallel to the inlet face of the horn. The divided sound passages 1, 2 and 2 are substantially equal to each other in the rate of area expansion, such that the areas of the divided sound passages 1, 2 and 2 in section taken along a plane perpendicular to the principal axis of the horn continuously increase at nearly equal rates to each other from the throat 5 to the mouth plane in the direction of the principal axis.

The partition walls 4 and 4 are formed with bulging portions 3 and 3 on their outer sides. The outer surfaces of the partition walls 4 and 4 are therefore curved along the principal axis of the horn. Positioned outwardly of the partition walls 4 and 4 are side walls 6 and 6 whose inner surfaces are likewise curved along the principal horn axis, with the result that the divided sound passages 2 and 2 are curved and are greater in length than the principal axis of horn included in the sound passage 1 of the divided horn.

Sound waves projected into the horn from the throat 5 are dividedly propagated through the divided sound passages 1, 2 and 2 and then radiated from the mouth plane. Since the divided sound passages 2 and 2 have a greater length than the divided sound passage 1, the propagation time taken for the sound wave to travel from the throat 5 to the mouth plane through the sound passages 2 and 2 is longer than the propagation time required for the sound wave to pass through the sound passage 1, so that the apparent propagation velocity is lower in the former case.

Accordingly, the apparent propagation velocity of sound wave at the mouth plane differs in accordance with the position from which the sound wave is radiated. Thus the sound wave will be refracted toward the direction where the sound wave velocity is lower. The index of refraction n at this time is given by Equation (a):

$$n = (Co/C) = (l/lo) \qquad \text{a.}$$

where $Co$ is the velocity of sound wave propagated through the sound passage 1, $C$ is the apparent velocity of sound wave propagated through the sound passage 2, $lo$ is the effective length of the sound passage 1 and $l$ is the effective length of the sound passage 2.

Thus the sound wave is refracted at the index of refraction $n$ given by Equation (a) toward the direction of straight directional line. Consequently, the sound waves are radiated from the mouth plane in spreading fashion, whereby wide directional characteristics are available.

The refraction due to the difference in the length of passages is represented by Equation (b):

$$(n^2 - 1)x^2 + 2fx(n-1) - y^2 = 0 \qquad \text{b.}$$

where $n$ is the index of refraction, $x$ is the length of centerline of the sound passage 1, $f$ is a virtual focal distance of curved waves radiated from the mouth plane, $y$ is the distance between the central axis of the sound passage 1 and the central axis of the sound passage 2 in the mouth plane.

From Equation (a) and Equation (b), $$l = -f + \sqrt{(x+f)^2 + y^2}$$

Since $x = lo$, $$l = -f + \sqrt{(lo+f)^2 + y^2} \qquad \text{c.}$$

Accordingly, if the virtual focal distance f is given as desired, $l$ will be determined by the value of $y$.

Figure 2:
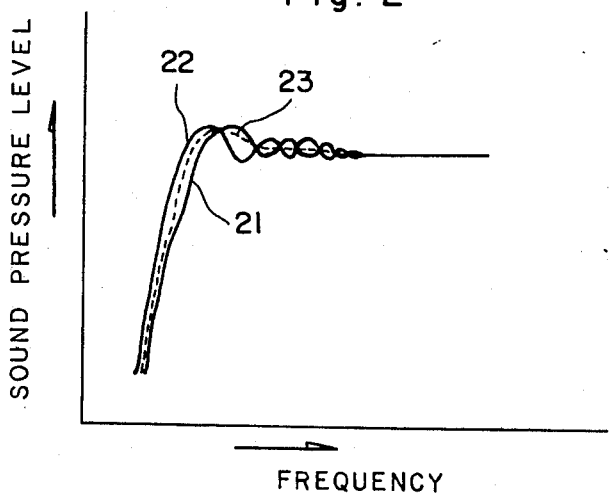
FIG. 2 is a diagram showing the impedance characteristics of the horn speaker.

The effect of the present invention derived from the planar mouth surface of the horn will be described. Generally, if a horn of a short length is used to compact the horn speaker, the impedance characteristics exhibit peaks and valleys at low frequencies as indicated at 21 in FIG. 2 to impair the sound quality.

However, with the horn speaker of this invention, the sound passage 2 has a greater length than the sound passage 1, with the result that the impedance characteristics (indicated at 22 in FIG. 2) of the sound passage 2 and the impedance characteristics (indicated at 21 in FIG. 2) are displaced from each other with respect to the frequency axis. Thus the characteristics of the sound passage 1 and the characteristics of the sound passage 2 are combined to give smooth overall charactertistics (indicated at 23 in FIG. 2), with the peaks and valleys of the former offsetting those of the other. A horn speaker is therefore available which is adapted for sound reproduction at low frequencies without objections and which is low in the threahold frequency for low-frequency reproduction in spite of its compactness.

Next the number of divided sound passages will be described in relation to the directional charateristics and impedance characteristics. The relation between the angle of refraction $\Theta$ and the index of refraction $n$ is given by: $n = 1/\cos\Theta$. It therefore follows from Equation (a) that $\cos\Theta = lo/l$.

Thus the cosine of the angle of refraction $\Theta$ is determined by the ratio of $lo$ to $l$. The smaller the $lo/l$, namely the greater the $l$, the larger will be the angle of refraction in the divided passage 2, giving wider directivity. However, if the number of divided passages is small, there occurs a valley in the directional characteristics curve and, even within the directional angle, a low sound pressure will result. Further to utilize the peaks and valleys in the impedance characteristics at low frequencies effectively, the peak in the characteristics of the divided sound passage 2 must be superposed on the valley in the characteristics of the divided sound passage, and vice versa, so that the ratio between $l$ and $lo$ need be selected suitably, hence the angle of refraction $\Theta$ is limited.

Figure 3:
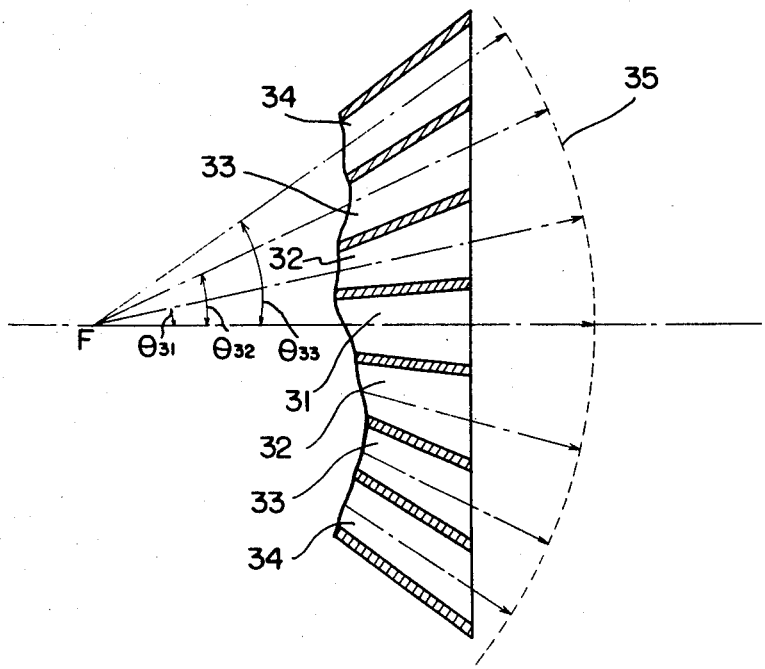
FIG. 3 is a view illustrating the radiation of sound waves.

Accordingly, it may be considered to divide the sound passage into a greater number. FIG. 3 shows a sound passage divided into seven divisions. Suppose the divided sound passages 31, 32, 32, 33, 33, 34 and 34 have effective lengths of $l_{31}$, $l_{32}$, $l_{33}$ and $l_{34}$. The divided sound passage 31 and divided sound passage 32 give an angle of refraction $\Theta_{31}$, with which $\cos\Theta_{31} = l_{31}/l_{32}$. In respect of the angle of refraction $\Theta_{32}$ given by the divided sound passages 31 and 33, $\cos\Theta_{32} = l_{31}/l_{33}$. In the case of the angle of refraction $\Theta_{33}$ given by the divided sound passages 31 and 34, $\cos\Theta_{33} = l_{31}/l_{34}$. The size and direction of the sound waves emerging from the divided sound passages are indicated by the arrows in the figure. The shape of the sound waves is represented by an envelope obtained by connecting the tips of the arrows together and centered about a virtual focal point F. It therefore follows that the greater the number of divided sound passages, the more closely the waveshape resembles a smooth curve.

The impedance characteristics of this horn speaker will be described. The impedance characteristics of the divided sound passage 31 are deviated from the characteristics of the divided sound passage 32. Similarly, the characteristics of the divided sound passage 32 are deviated from those of the divided sound passage 33, the characteristics of the divided sound passage 33 from those of the divided sound passage 34, respectively. Consequently, the four characteristics offset each other to result in overall characteristics which are smoother than those of FIG. 2 to assure more satisfactory reproduction at low frequencies.

When the horn is divided into an increased number of sound passages as above, a correspondingly increased number of partition walls are necessary. This increases the cost but the product obtained is satisfactory in directional properties and frequency characteristics.

Next, embodiments of this invention will be described. The horn speaker shown in FIG. 4 has three sound passages 41, 42 and 43 divided by two partition walls 44 and 44 extending through the horn in the direction of principal axis thereof. The horn has a rectangular mouth and a first straight directional line coinciding with the longitudinal central axis of the rectangular. The partition walls 44 and 44 are formed with bulging portions 43 and 43. The inner surfaces of the side walls 46 and 46 include first portions 46a and 46a which are positioned toward the direction of the first directional line and curved along the principal horn axis, such that the relation of Equation (c) will be established on the first directional straight line.

The number of the partition walls need not necessarily be two but may be any even number to form an odd number of divided sound passages symmetrically with respect to the principal horn axis in the direction of the first direction straight line.

Figure 4:
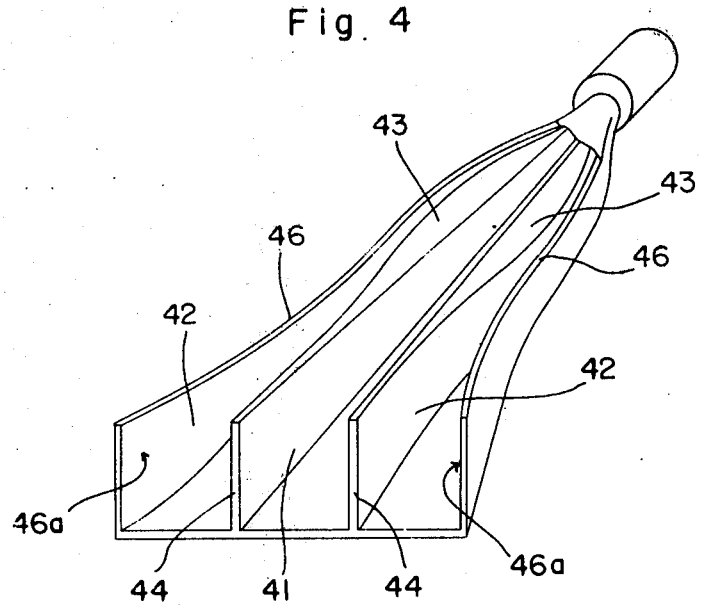
FIG. 4 is a perspective view partly broken away and showing an embodiment of the horn speaker according to this invention.
Figure 6:
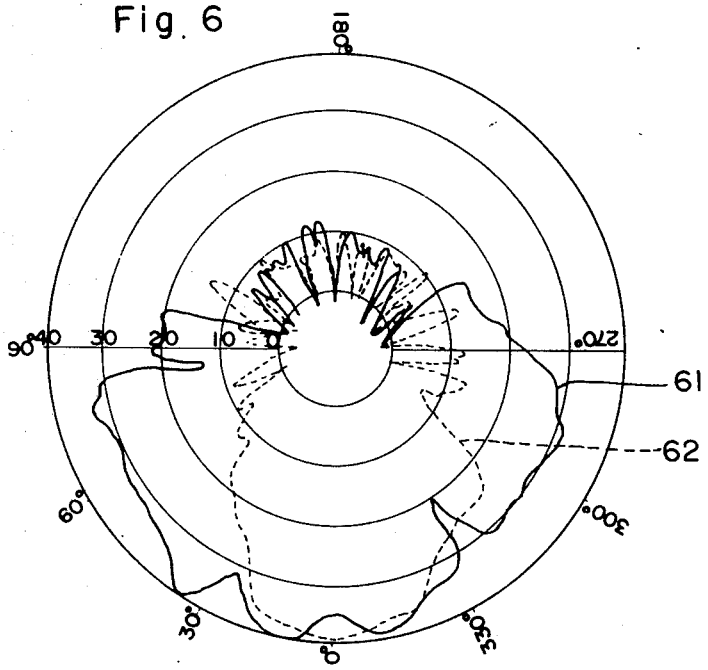
FIG. 6 and 7 are diagrams showing the directional characteristics curves and frequency characteristics of the horn speakers illustrated in FIGS. 4 and 5.

FIG. 6 shows the values of directional characteristics of horn speakers as actually measured, wherein indicated at 62 are the directional characteristics of a conventional horn speaker having no partition walls, whilst indicated at 61 are the directional characteristics of a horn speaker having the construction of FIG. 4. Comparison between these two characteristics 61 and 62 indicates that the horn speaker of the present invention has greatly improved directional characteristics.

Figure 7:
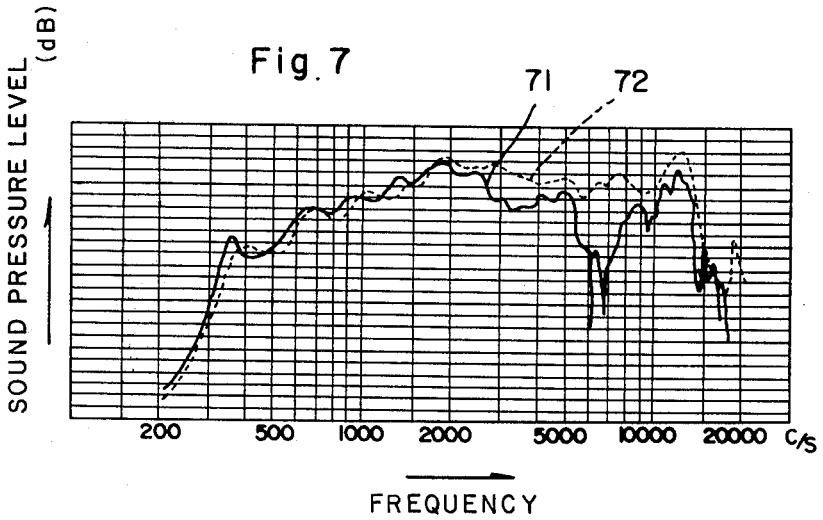

FIG. 7 shows the actually measured values of frequency characteristics, wherein those of a conventional horn speaker with an individed horn are indicated at 72 and those of a horn speaker having the construction of FIG. 4 are designated at 71. Comparison between the two reveals that the first peak of the curve 71 is positioned at a lower frequency than the curve 72, this showing a lower threshold frequency for low-frequency reproduction.

Figure 5:
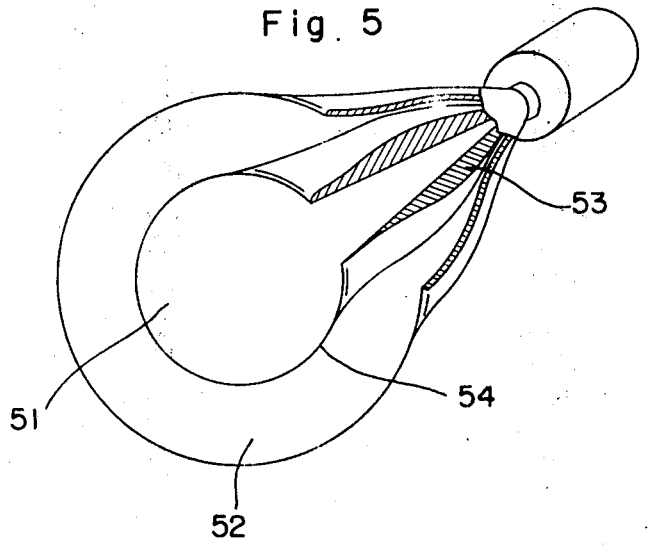
FIG. 5 is a perspective view partly broken away and showing another embodiment of the horn speaker according to this invention.

While the horn speaker shown in FIG. 4 has a rectangular mouth, with the straight directional line oriented only in one direction, FIG. 5 shows another embodiment wherein the directional line is oriented in every direction. More specifically, the horn speaker of FIG. 5 includes one cylindrical partition wall 54 having a central axis substantially in coincidence with the principal axis of the horn and dividing its sound passage into two divisions 51 and 52. The mouth of the horn is circular and every diametrical direction of the mouth plane substantially coincides with the straight directional line described above. Further when seen in cross section in parallel to the mouth plane, the first divided sound passage 51 including the principal horn axis has a generally circular shape, whilst the second divided sound passage 52 surrounding the first divided sound passage 51 has an annular shape. Although the embodiment of FIG. 5 has one partition wall 54, which includes a thickened portion 53 intermediate its ends a plurality of partition walls may of course be provided whether in an even or odd number. The thickened portion 53 of the partition wall 54 extends only radially outward, the inwardly facing surface of the partition wall 54 does not exhibit any bulge. Thus, the sound passage 52 is longer than the sound passage 51.

Sound waves travelling dividedly through the sound passages 51 and 52 are refracted and diffused at the mouth plane and radiated therefrom as spherical waves due to the difference in apparent velocity between sound waves passing through the sound passages 51 and 52.

As already described, the horn speaker according to this invention has remarkably improved directional characteristics and is lowered in threshold frequency for low-frequency reproduction and can therefore be made compact. With the planar mouth surface, the speaker is easy to mount in a speaker box and saves the space for installation.

The horn speakers as shown in FIGS. 4 and 5 are thus adapted for improved directional characteristics by dividing the sound passage with partition walls. Consequently, where a small number of partition walls are used, the frequency characteristics obtained have the drawback that the sound pressure will be markedly attenuated at a specific frequency. More specifically, if a small number of partition walls are used, there arises a need to increase the difference between the lengths of divided passages to widen the directivity, such that the difference in length between the passages changes greatly stepwise. As a result, depending on the wavelength, a sound wave from one divided sound passage will offset, by means of the difference in passage length at the mouth plane, a sound wave from another passage with a reverse phase, causing abrupt attenuation of sound pressure.

The attenuation of sound pressure at a specified frequency may be remedied by increasing the number of partition walls to reduce the difference in the length per passage and to thereby eliminate a sound wave of reverse phase, but this makes the speaker complex in construction and cumbersome to assemble and require a greater number of parts, resulting in a cost increase.

Figure 8:
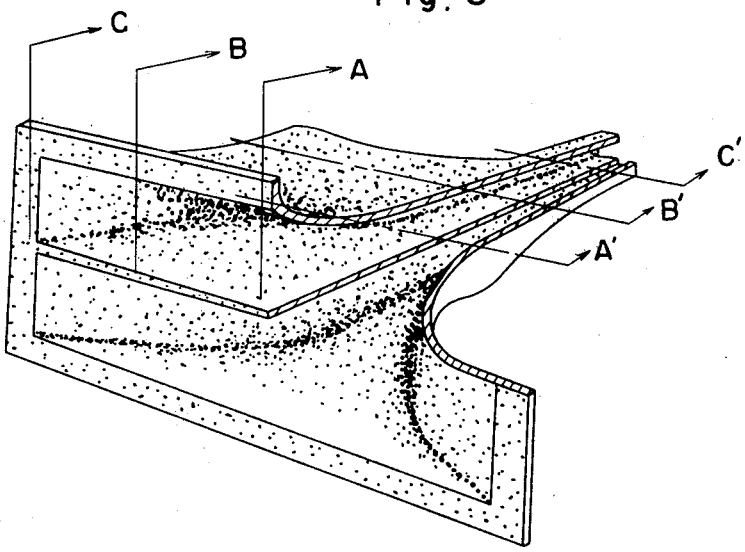
FIG. 8 is a perspective view partly broken away and showing another embodiment of the horn speaker according to this invention.
Figure 13:
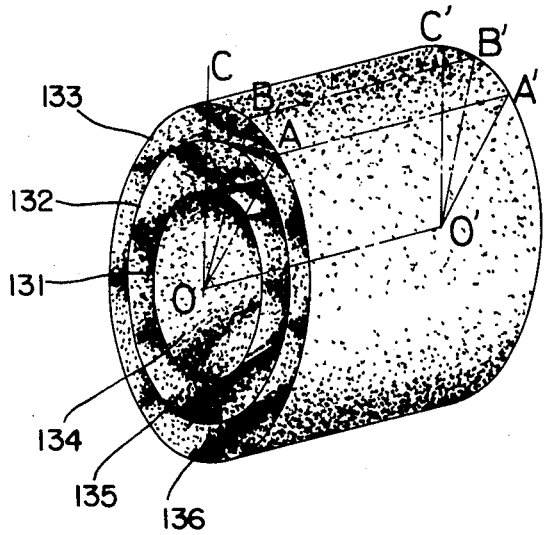
FIG. 13 is a perspective view showing another embodiment of the horn speaker according to this invention.

FIGS. 8 and 13 shows embodiments intended to overcome these drawbacks. The horn speaker shown in FIG. 8, an improvement of the embodiment shown in FIG. 4, does not employ a partition wall such as already described but is so designed that the effective length of passage is varied continuously with the interior shape of the horn defined by its side walls.

Figure 9:
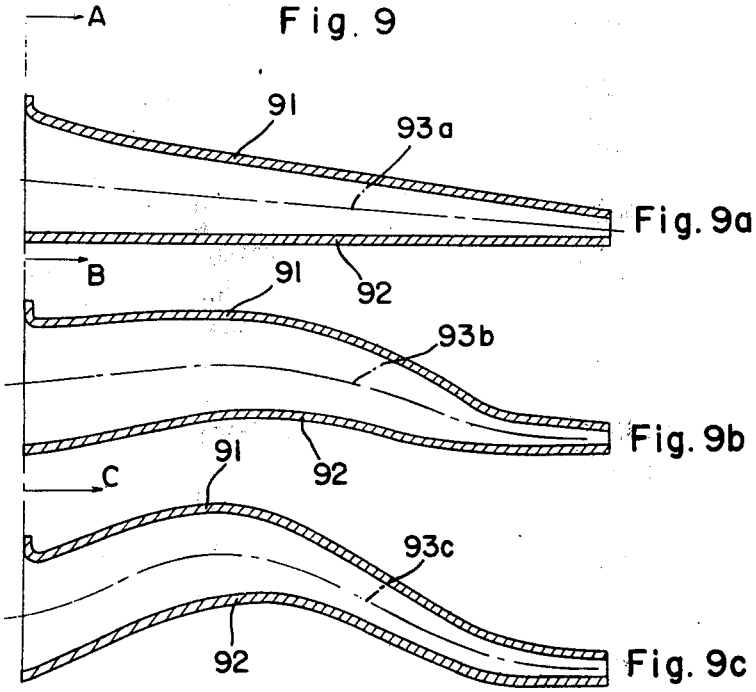
FIGS. 9(*a*), 9(*b*), and 9(*c*) and 10 are vertical sectional views of the horn speaker of FIG. 8 taken along the lines A, B and C along its principal horn axis.

FIG. 9 shows the horn speaker of FIG. 8 in longitudinal sections taken along the lines extending in the axial direction and dividing the distance between the principal axis of the horn and its side wall in definite proportions. The section along the arrow A is closed to the principle axis, the section along the arrow B shows an intermediate portion and the section along the arrow C is proximate to the side wall.

Put in greater detail, the section (*a*) in FIG. 9 taken along the arrow A shows a sound passage defined by upper and lower walls 91 and 92. An effective centerline 93a extending midway between the upper and lower walls 91 and 92 is a gently curved line resembling a straight line. The section (*b*) of FIG. 9 taken along the arrow B shows the sound passage curved by the upper and lower walls 91 and 92, so that the effective centerline **93*b* is much more curved than the effective centerline 93*a* shown in FIG. 9** (*a*). The length of effective centerline (**93*b*), namely the effective length of the passage, is therefore greater than that of FIG. 9** (*a*). FIG. 9 (*c*), the section along the arrow C, shows the upper and lower walls 91 and 92 as curved to a still greater extent to provide a passage having further greater effective length. Thus, respective portions of the sound passage, as illustrated respectively in FIGS. 9(*a*)–9(*c*), define respective virtual sound passages of different lengths. Stated differently, portions of a single sound passage cause some sound to travel a greater distance than sound travels in other portions.

Figure 10A:
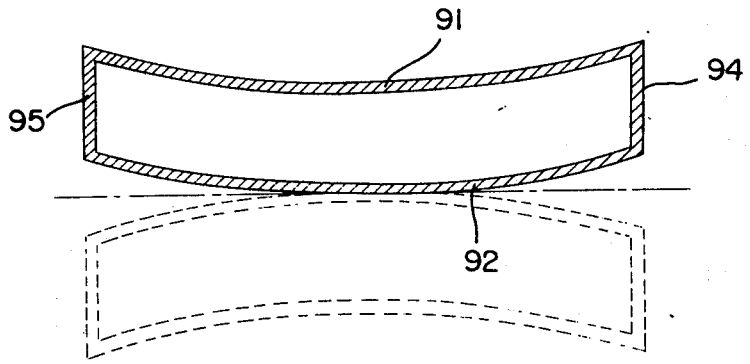
FIGS. 10(*a*), 10(*b*) and 10(*c*) are vertical sectional views showing the horn speaker of FIG. 8 along the lines A′, B′ and C′ in parallel to its mouth plane.
Figure 10B:
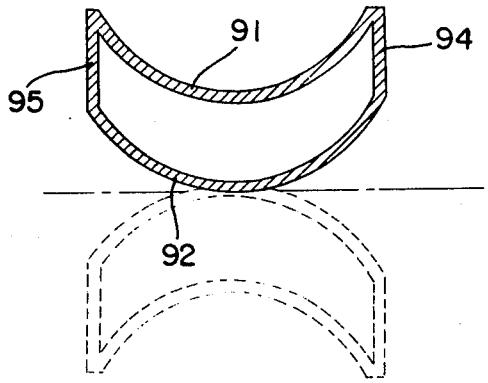
Figure 10C:
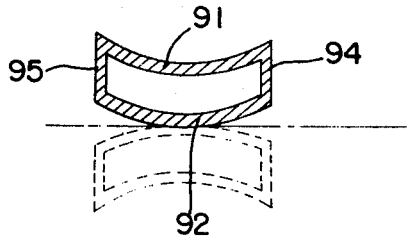

The views in FIG. 10 are in cross section taken along the lines A′, B′ and C′ in FIG. 8. FIG. 10 (*a*), a section A′ relatively close to the mouth plane, shows the sound passage defined by the right and left side walls 94 and 95 and upper and lower walls 91 and 92, the passage being symmetrical on the right and left. FIG. 10 (*b*) shows a section B′ at the approximate midportion of the principal horn axis where the upper and lower walls 91 and 92 are maximum in curvature. FIG. 10 (*c*) shows a section C′ proximate to the throat where the upper and lower walls 91 and 92 are reduced in curvature.

To sum up, the curvature (orthogonal to the principal horn axis) of the upper and lower walls 91 and 92 which are straight at the mouth progressively increases to a maximum at the approximate midportion of the principal horn axis [as shown in FIG. 10 (*c*)] and then reduces toward the throat, where the walls 91, 92 again become straight in section.

In other words, the side walls include the first portions 94 and 95 which are oriented in the direction of the aforesaid first straight directional line and curved along the principal horn axis, the side walls also including the second portions 91 and 92 which are oriented in the direction of a second straight directional line contained in the mouth plane and intersecting the first straight directional line at right angles. The second portions further are curved along the principal horn axis and along the first straight directional line as well. Briefly, the second side wall portions 91 and 92 are curved so that as the distance between a point within the mouth plane and the aforementioned intersection increases, the length of a passage for propagating a sound wave from the diaphragm to the mouth plane will also increase.

It will be apparent from the above that with the horn speaker shown in FIG. 8, the shape of the sound passage is ingeniously altered to thereby vary the effective length of sound passage. In fact, the horn speaker achieves the same effect as is produced by dividing the sound passage into an infinite number of divisions and exhibits satisfactory directional characteristics and frequency characteristics.

Figure 11:
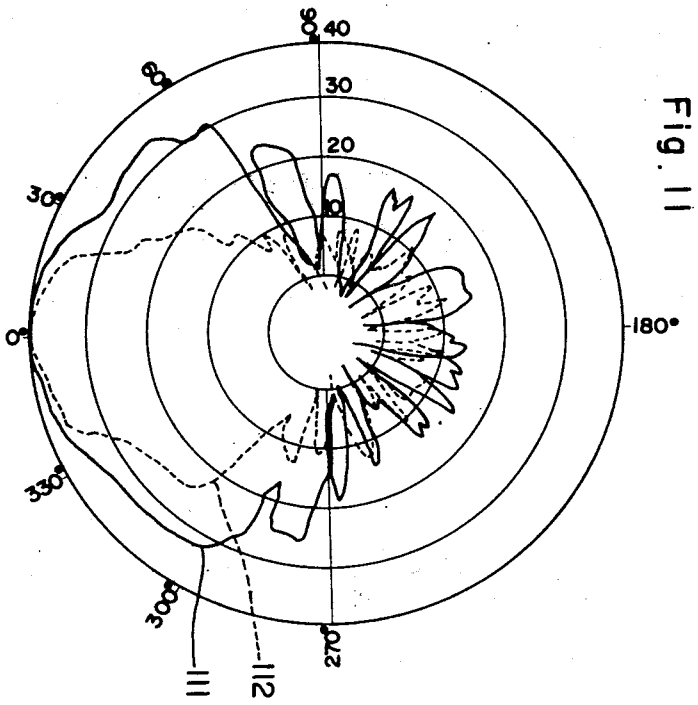
FIGS. 11 and 12 are diagrams showing the directional characteristics curves and frequency chharacteristics of the horn speaker illustrated in in FIG. 8.
Figure 12:
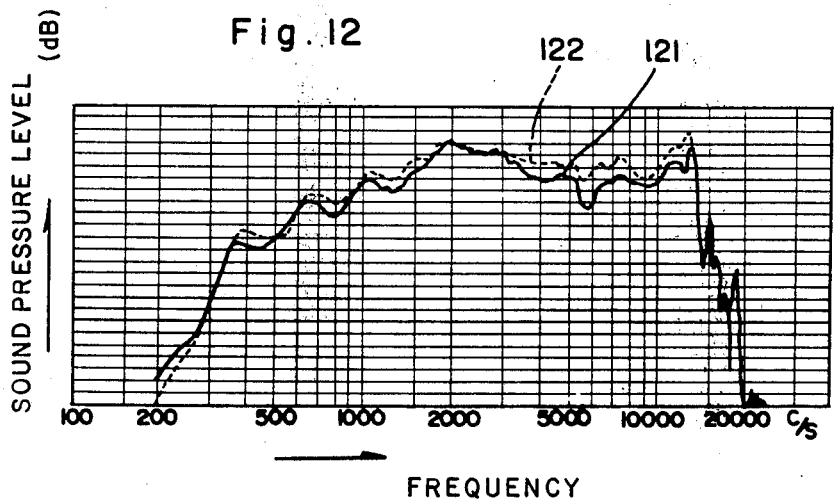

FIG. 11 shows the actually measured values of directional characteristics of this speaker as indicated at 111, whilst designated at 112 therein is a curve representing the directional characteristics of a conventional horn speaker. Further FIG. 12 shows frequency characteristics of this speaker as indicated at 121, wherein those of a conventional speaker are designated at 122.

Figure 14:
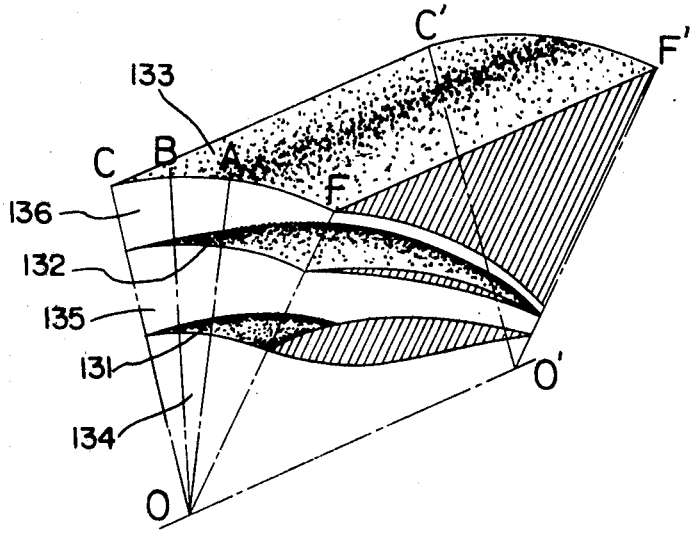
FIG. 14 is a perspective view partly broken away and showing the horn speaker of FIG. 13.

FIG. 13 shows an improvement of the horn speaker of FIG. 5. According to this improved embodiment, the sound passage is divided into divisions 134, 135 and 136 by two cylindrical partition walls 131 and 132 having a central axis substantially in coincidence with the principal horn axis. As seen in FIG. 14, the partition walls 131 and 132 are formed with bulging portions continuously varying in thickness in the direction of the principal horn axis and also in the circumferential direction.

Figure 15A:
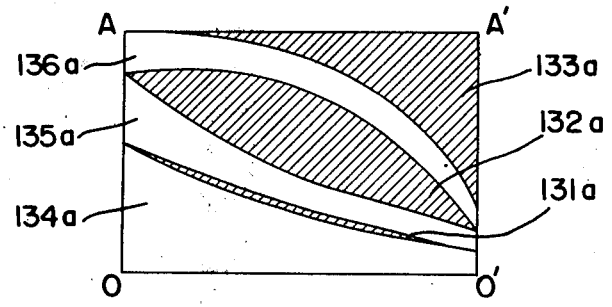
FIGS. 15(*a*), 15(*b*), 15(*c*) and 16(*a*), 16(*b*), 16(*c*) are longitudinal sectional views showing the horn speaker of FIG. 13 and containing the principal horn axis thereof and views showing a quarter of the same in cross section in parallel to the mouth plane thereof.
Figure 15B:
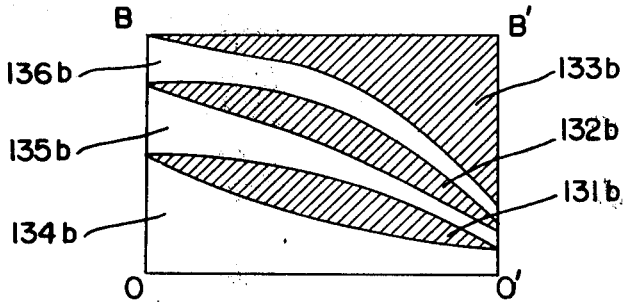
Figure 15C:
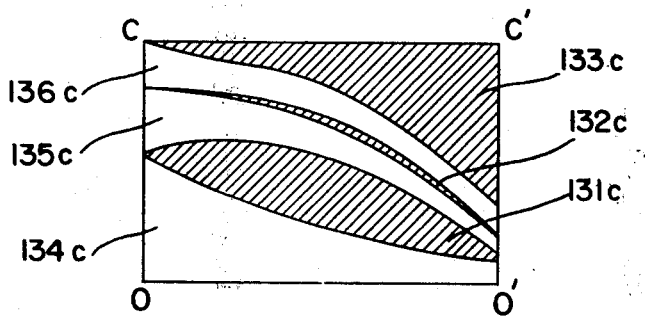

With reference to FIG. 15 showing the horn speaker of FIG. 13 in longitudinal section containing the principal horn axis, FIG. 15 (*a*) a section A—O—O′—A′ of FIG. 13, FIG. 15 (*b*) is a section B—O—O′—B′ of the same and FIG. 15 (*c*) is a section C—O—O′—C′ of the same.

Although the first sound passage 134 is uniform in any of the sections 134*a*, 134*b* and 134*c*, the annular second divided sound passage 135 positioned around the first sound passage 134 has varying lengths as at 135*a*, 135*b* and 135*c*, namely a minimum at 135*a* which progressively increases toward 135*b* and reaches a maximum at 135*c*. Further the other second vidided sound passage 136 has a maximum length at 136*a*, which progressively reduces toward 136*b* and decreases to a minimum at 136*c*. Although these divided sound passages are distorted, their sectional areas of course change at a constant rate from the throat to the plane of mouth along the principal horn axis.

Figure 16A:
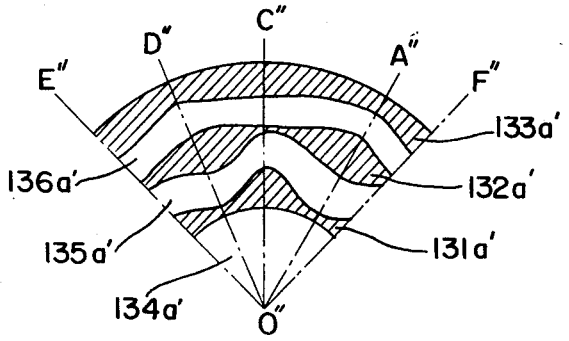
Figure 16B:
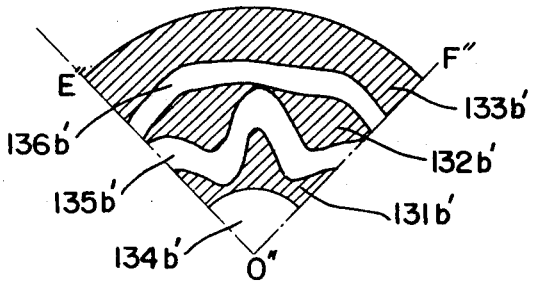
Figure 16C:
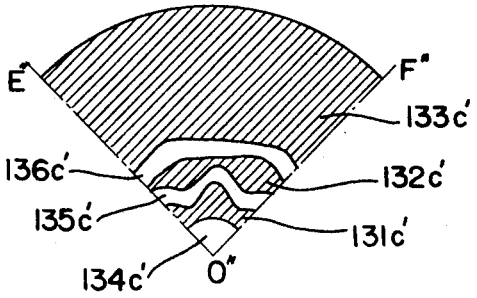

FIG. 16 shows quartered cross sections in parallel to the mouth plane. FIG. 16 (*a*) is a section relatively close to the mouth plane, FIG. 16 (*b*) is that of midportion and FIG. 16 (*c*) is that relatively close to the throat.

It will be apparent from FIG. 16 that when seen in cross section in parallel to the mouth plane, the first divided sound passage 134 is generally circular, whereas the annular second sound passages 135 and 136 are wavy and undulating. The waveshapes of both the second divided sound passages 135 and 136 need not necessarily be uniform in period and in the levels of ridges and furrows, but the point where the sound passage 135 has a maximum length and the point where the sound passage 136 has a minimum length are positioned on the same radial line.

With reference to FIG. 16 (*a*), for example, the ridge of the sound passage 135*a*′ and the furrow of the sound passage 136*a*′ are positioned on the linde O″—O″ passing through the center. The difference in length between the sound passage 134 and sound passage 135 is minimum on the line O″—O″ and increases circumferentially toward the line O″—O″ or O″—F″, where it is maximum. Further in the circumferential direction, the difference reduces progressively. Likewise, the difference in length between the sound passage 135 and the sound passage 136 is minimum on the line O″—O″ or O″—F″ and maximum on the line O′λ′—A″ or O″—D″. Between these lines, the difference varies continuously. If the sound passages 134 and 135 are made as equal as possible in length on the line O″—A2, the difference in passage length can be varied continuously from zero. Similarly, if the sound passages 135 and 136 are made as equal as possible on the line O″—C″ or O″ —F, the difference in passage length can be varied continuously from zero.

As already described, the wavy undulation of the sound passage in the circumferential direction need not be periodically regular but may alter from place to place circumferentially. Furthermore the ridge and furrow levels need not be constant. However, the position where one sound passage has a maximum length must radially coincides with the position where the adjacent sound passage has a minimum length. The period of wavelike undulation way preferably be short to obtain effective results. Moreover, the greater the number of partition walls, the better will be the resulting directional characteristics and frequency characteristics.

Figure 18:
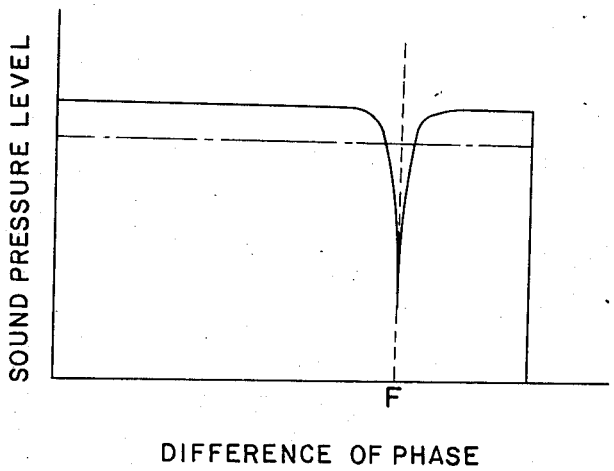

As already described, the two second divided sound passages 135 and 136 are wavy and undulating, with the difference in passage length varying continuously with the circumferential deviation of the first divided sound passage 134, with the result that the phase deviation resulting from the difference in passage length will be distributed continuously, starting with zero. The factor leading to reversion of phase is little, if any, (i.e. at F in FIG. 18). Since the overall sound level is given in terms of integrated value of the curve, attenuation of sound pressure hardly takes place.

With reference to FIG. 17 showing frequency characteristics, those of the horn speaker of FIG. 13 are indicated in solid lines, while indicated in dot lines are the characteristics of a speaker having the same number of divided passages but the partition walls are not provided with undulations.

The frequency characteristics in FIG. 17 (*a*) are determined at a directional angle of zero, FIG. 17(*b*) showing those at a point deviated by 30 degrees from the center and FIG. 17 (*c*) those at a point with deviation of 45°. Comparison between the two indicates that the attenuation of sound pressure is eliminated at around 7,000 Hz, 13,000 Hz and 17,000 to give flat frequency characteristics.

With the horn speaker illustrated in FIG. 13, the attenuation of sound pressure can be eliminated, and a greater effect will be achieved with the increase in the number of annular second divided sound passages. However, the making of the wavy partition walls required is no easy job and may entail a cost increase. This has been overcome with the embodiment shown in FIG. 19 in which a cylindrical partition wall that can be produced more easily is used to achieve the same effectiveness as will be attained by the horn speaker illustrated in FIG. 13.

Figure 19:
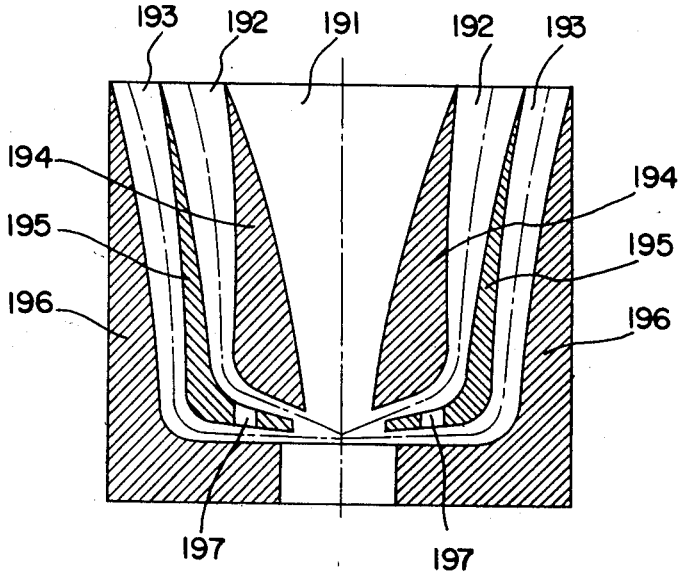
FIG. 19 is a view in longitudinal section showing another embodiment of the horn speaker according to this invention.
Figure 20:
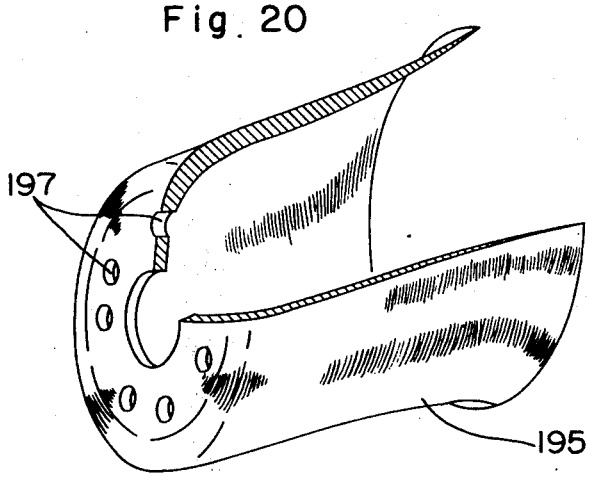
FIG. 20 is a perspective view partly broken away and showing a partition wall used in the horn speaker of FIG. 19.

With reference to FIG. 19, the sound passage is divided into three divisions 191, 192 and 193 by two cylindrical partition walls 194 and 195 having a central axis coinciding with the principal horn axis. When seen in cross section in parallel to the plane of mouth, the first divided sound passage 191 including the principal horn axis is generally circular and the second divided sound passages 192 and 193 are annular. The partition wall 195 is formed with a plurality of penetrating bores 197 at desired positions along a circumference centered about the principal horn axis.

Accordingly, the sound wave travelling through the outer second divided sound passage 193 partly enters the second divided sound passage 192 through the bores 197, whereupon the wave joins with the sound wave travelling through the inner second divided sound passage 193. At this time, the sound wave travelling inward from the outer second divided sound passage 193 through the bore 197 has passed a greater distance than the sound wave which has reached the bore 197 through the inner second divided sound passage 192 and is therefore delayed in phase. As a result, the phase of the sound wave combined from those travelling through the second divided sound passages 192 and 193 lags behind the phase of sound wave in the inner second divided sound passage 192 but is ahead of the phase of sound wave travelling through the outer second divided sound passage 193. Thus within the inner sound passage 192, the phase of sound wave travelling through the position of the bore 197 lags behind the phase of sound wave travelling through a position where the bore 197 is not formed.

Figure 22:
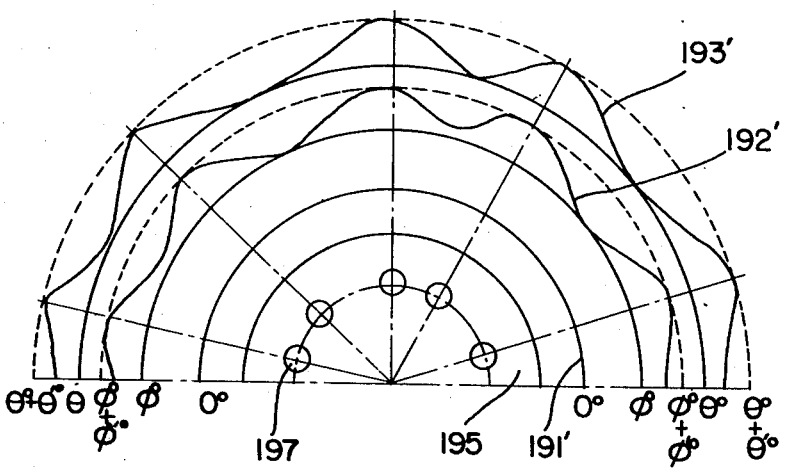

In the plane of the mouth, the sound waves exhibit a phase distribution as illustrated in FIG. 22. The phase 191′ of the sound wave from the first divided sound passage 191 is uniform along the circumference of the horn and is indicated as $O^o$. The delay of phase involved in the inner second divided sound passage 192 due to the difference in passage length is designated at $\phi^o$, and the delay of phase of the combined sound wave at the bore 197, at $\phi^o + \phi^o$. Designated at 192' in FIG. 22 is the phase distribution given by the sound waves from the inner second sound passage 192 and first sound passage 191 in the mouth plane at the sound passage 192.

Put in detail, the sound wave has a phase value of $\phi^o + \phi'^o$ at a point on the mouth plane which point is positioned on the same radial line as the bore 197 when seen in FIG. 22, whereas the sound wave has a phase value of $\phi^o$ at another point on the mouth plane which point is not positioned on the radial line on which the bore 197 is located. In effect, the sound wave emerging from the bore 197 is diffused as it travels forward through the sound passage, with the result that a wavy undulating phase is obtained which continuously alters between $\phi^o + \phi'^o$ and $\phi^o$. The slope of the undulation alters with the position and size of the bore 197 and the degree of diffusion of the sound wave.

Indicated at 193' in FIG. 22 is a phase distribution in the mouth plane at the outer second divided sound passage 193 which is likewise produced by the sound wave travelling from the inner second sound passage 192, through the penetrating bores 197 into the outer sound passge 193 and then passing therethrough.

Figure 23:
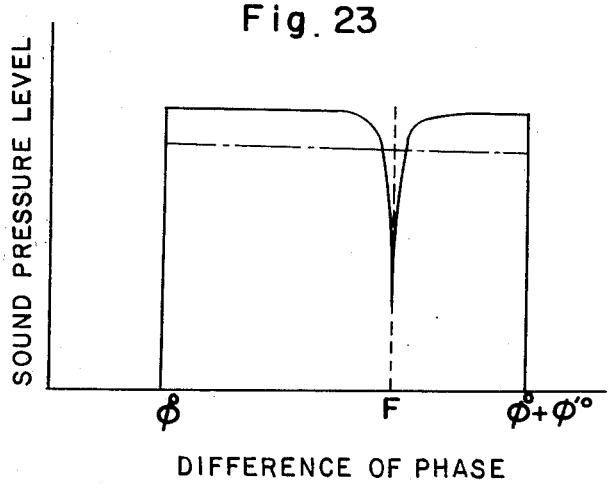

Thus with the provision of the penetrating bores 197 in the partition wall 195, it becomes possible to generate sound waves continuously varying in phase along a circumference within the same divided sound passage to give continuous distribution of phase difference, as seen in FIG. 23, in which reversion of phase, if any (as at F in FIG. 23), will hardly cause attenuation of sound pressure as a whole. Despite the easiness of production owing to the use of a cylindrical partition wall, the same effectiveness is expected as will be attained by the horn speaker illustrated in FIG. 13.

Figure 21:
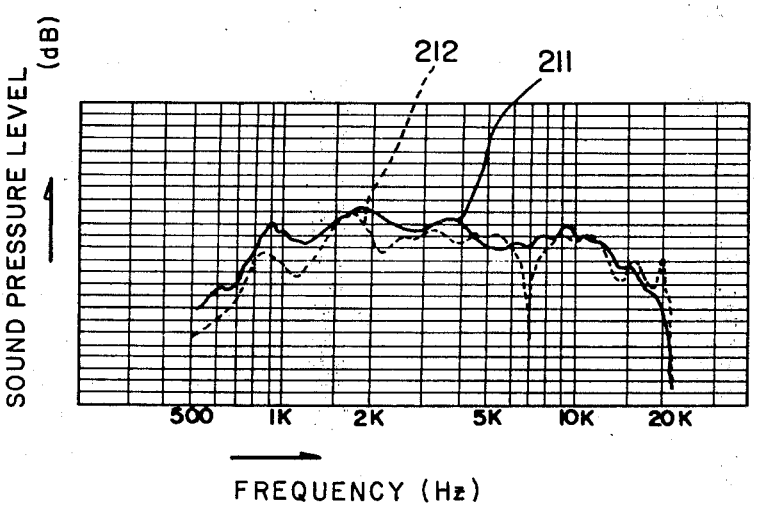
FIGS. 21, 22 and 23 are a diagram showing the frequency characteristics of the horn speaker of FIG. 19, a diagram showing the distribution of sound wave phases in the horn mouth plane of the same and a diagram showing the relationship between phase difference and sound pressure level relating to the same speaker.

With reference to FIG. 21 showing the frequency characteristics as actually measured, the characteristics of this speaker is indicated at 211, while designated at 212 is those of a horn speaker having the same dimensions but no penetrating bores. Apparently, the drawing reveals that the abrupt attenuation of sound pressure at about 7,000 Hz has been eliminated, hence flat overall characteristics.

Although the penetrating bores 197 are formed only in the partition wall 194 to achieve similar effects. Further the number of the partition walls may suitably be increased, in which case improved directional characteristics and low-frequency characteristics can of course be available.

Furthermore, although the position of the planar mouth surface has been illustrated and described in the foregoing description in its preferred embodiment as substantially in parallel to the inlet face of the horn, it will be understood that a slight deviation in the position of said surface is allowed.

What we claimed is:

1. A horn speaker comprising a diaphragm and a side wall and at least one interior sound partition, forming at least two passages for radiating sound waves emitted from the diaphragm, the horn speaker having a substantially straight principal horn axis and a generally planar mouth surface positioned substantially in parallel to the inlet face of the horn, the area of each sound passage in section taken along a plane perpendicular to the principal horn axis increasing continuously at a substantially constant rate of area expansion from a throat to the plane of the mouth in the direction of the principal horn axis, the horn speaker being characterized in that said at least one interior sound partition has inner and outer surfaces, at least said outer surface being curved along the principal horn axis to give substantially the relationship for each sound passage represented by the equation:

$$l = -f + \sqrt{(lo + f)^2 + y^2}$$

wherein $l$ is the effective length of the sound passage for propagating sound waves from the diaphragm to a point at a distance of $y$ from the intersection of the principal horn axis with the mouth plane, the point being positioned on at least one first straight directional line contained in the mouth plane and passing through the intersection, $lo$ is the length of the principal horn axis and $f$ is a virtual focal distance.

2. The horn speaker is set forth in claim 1 wherein the mouth surface is generally in the form of a rectangle having a longitudinal axis substantially coinciding with the first straight directional line.

3. The horn speaker as set forth in claim 2 wherein said horn speaker comprises an odd number of said sound passages, formed by said side wall and by an even number of said interior sound partitions, and symmetrically arranged with respect to the principal horn axis in the direction of the first directional line.

4. The horn speaker as set forth in claim 1 wherein the mouth surface is generally circular and every diametrical direction of the plane of the mouth substantially coincides with the directional line.

* * * * *

UNITED STATES PATENT OFFICE

CERTIFICATE OF CORRECTION

Patent No. 3,972,385 Dated August 3, 1976

Inventor(s) Masanori Hino, Taro Eguchi and Chitoshi Shiraga

It is certified that error appears in the above-identified patent and that said Letters Patent are hereby corrected as shown below:

Col. 2, line 37, "mouth" should be --smooth--.

Col. 3, line 17, "chharacter-" should be --character- --.

Col. 5, line 18, "charateristics" should be --characteristics--.

Col. 6, line 37, "individed" should be --undivided--;

line 62, after "ends" insert a comma --,--.

Col. 7, line 49 "closed" should be --close--;

line 50, "principle" should be --principal--.

Col. 9, lines 44 & 45, "O'λ'" should be --O''--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*